US011655637B2

(12) United States Patent
Allesen

(10) Patent No.: US 11,655,637 B2
(45) Date of Patent: May 23, 2023

(54) SEALING GASKET, FLASHING ARRANGEMENT, AND METHOD OF SEALING A GAP BETWEEN FLASHING MEMBERS FOR A ROOF WINDOW

(71) Applicant: VKR Holding A/S, Hørsholm (DK)

(72) Inventor: Torben Krogsgaard Allesen, Horsens (DK)

(73) Assignee: VKR Holding A/S

( * ) Notice: Subject to any disclaimer, the term of this patent is extended or adjusted under 35 U.S.C. 154(b) by 214 days.

(21) Appl. No.: 16/953,102

(22) Filed: Nov. 19, 2020

(65) Prior Publication Data

US 2021/0172175 A1 Jun. 10, 2021

(30) Foreign Application Priority Data

Dec. 5, 2019 (DK) ..... PA 2019 70748

(51) Int. Cl.
*E04D 13/03* (2006.01)
*E04D 1/36* (2006.01)

(52) U.S. Cl.
CPC ..... *E04D 13/031* (2013.01); *E04D 1/36* (2013.01)

(58) Field of Classification Search
CPC ..... E04B 7/06; E04B 7/18; E04D 1/36; E04D 13/03; E04D 13/0305; E04D 13/031;
(Continued)

(56) References Cited

U.S. PATENT DOCUMENTS 3,378,958 A * 4/1968 Parks ..... E06B 7/231 49/495.1
4,070,806 A * 1/1978 Hubbard ..... E04D 3/08 52/95

(Continued)

FOREIGN PATENT DOCUMENTS

CN 108868537 11/2018
DE 10149532 3/2003

(Continued)

OTHER PUBLICATIONS

European Opinion and Extended Search Report dated Apr. 6, 2021 issued in connection with European Application No. 20211489, eight (8) pages.

(Continued)

*Primary Examiner* — James M Ference
(74) *Attorney, Agent, or Firm* — Merek, Blackmon & Voorhees, LLC

(57) ABSTRACT

A sealing gasket (4) for use between flashing members (31,32) is disclosed. It comprises a compressible sealing section and an attachment section comprising at least two legs configured for engagement with a flashing member, both sections extending over substantially the entire length of the sealing gasket. The at least two legs of the attachment section project from a base section of the attachment section so that a first recess and a second recess extending in parallel are defined, said first and second recesses being configured for engagement with a flange, ridge, or leg on a flashing member. The invention further relates to a flashing arrangement and to a method of sealing a gap between flashing members for a roof window.

21 Claims, 4 Drawing Sheets

(58) Field of Classification Search
CPC ..... E04D 13/1693; E04D 13/174; E04D 2001/305; E04D 2003/0818; E04D 2003/0875; E06B 7/2305
See application file for complete search history.

(56) References Cited

U.S. PATENT DOCUMENTS 4,114,330 A * 9/1978 Sukolics ..... E04D 3/08 52/460
4,589,238 A * 5/1986 Sampson ..... E04D 13/0305 52/200
4,702,049 A * 10/1987 Sampson ..... E04D 13/0305 52/200
4,703,592 A * 11/1987 Sampson ..... E04D 13/0305 52/20
4,850,167 A * 7/1989 Beard ..... E04D 3/08 52/200
4,896,468 A * 1/1990 Sampson ..... E04D 13/0305 52/200
4,926,594 A * 5/1990 Sampson ..... E04D 13/0305 52/656.5
4,928,445 A * 5/1990 Sampson ..... E04D 13/0354 49/495.1
4,972,638 A * 11/1990 Minter ..... E04D 13/1475 52/200
4,987,705 A * 1/1991 Sampson ..... E04D 13/03 52/72
4,995,208 A * 2/1991 Sampson ..... E04D 13/03 52/200
5,044,133 A * 9/1991 Sampson ..... E04D 13/0305 49/495.1
5,355,644 A * 10/1994 Guhl ..... E04D 13/0305 52/200
5,411,785 A * 5/1995 Cook ..... B60J 10/80 52/716.5
5,622,008 A * 4/1997 King ..... B60J 10/34 49/490.1
5,960,596 A * 10/1999 Lyons, Sr. ..... E04D 13/031 52/72
7,331,145 B2 * 2/2008 Feucht ..... E04D 13/02 52/409
2002/0095884 A1 * 7/2002 Lindgren ..... E06B 9/58 52/72
2004/0139669 A1 * 7/2004 Feucht ..... E04D 13/0315 52/204.5
2005/0000173 A1 * 1/2005 Lindgren ..... E06B 7/2301 52/200
2009/0031640 A1 * 2/2009 Elmes ..... F24S 80/70 52/60
2021/0172175 A1 * 6/2021 Allesen ..... E04D 13/031

FOREIGN PATENT DOCUMENTS

| | | |
|---|---|---|
| DE | 202009004998 | 10/2009 |
| GB | 2159851 | 12/1985 |
| GB | 2309983 | 8/1997 |
| GB | 2462998 | 3/2010 |
| KR | 20090010117 | 10/2009 |

OTHER PUBLICATIONS

Search Report issued in Danish Patent Application No. PA 2019 70748 dated Jul. 6, 2020, three pages.

* cited by examiner

SEALING GASKET, FLASHING ARRANGEMENT, AND METHOD OF SEALING A GAP BETWEEN FLASHING MEMBERS FOR A ROOF WINDOW

A sealing gasket for use between flashing members, a flashing arrangement for a roof window including at least two flashing members and at least one sealing gasket, and method of sealing a gap between flashing members for a roof window

TECHNICAL FIELD

The present invention relates to a sealing gasket for use between flashing members, comprising a compressible sealing section and an attachment section comprising at least two legs configured for engagement with a flashing member, said sealing gasket having a length direction and a width direction extending perpendicular to the length direction, and said sealing section and said attachment section both extending over substantially the entire length of the sealing gasket when seen in the length direction. Furthermore, the invention relates to a flashing arrangement for a roof window including at least two flashing members and at least one sealing gasket and to a method for sealing a gap between flashing members for a roof window.

BACKGROUND ART

It is known to ensure a watertight transition between a window installed in a roof and the surrounding roofing. Traditionally, a flashing arrangement comprising a number of flashing members is installed such that the flashing members overlap. At places where the flashing members do not come into tight contact with each other, the gap between them is shaped such that wind entering will be slowed down, thereby hindering air and dirt penetration into the structure. Such a specially shaped gap is also known as a labyrinth seal.

Labyrinth seals have been found to work very well, often even better than physical seals, such as sealing gaskets and joint fillers, but the dimensions of the gap need to be within certain limits for the labyrinth seal to work. As a consequence, the possibility for changing the relative angle between flashing members is limited, and different flashing arrangements therefore often have to be provided for roof window installations in roofs with different inclinations. This problem is particularly relevant when roof windows are installed in a so-called ridge structure, where the top frame members of two windows are arranged next to each other and the panes inclining in different directions. In such cases it is common to cover the gap between the top frame members by one common ridge flashing member, and a change of the angle of inclination of a window will result in a change in the distance between the ridge flashing member and the part of the window, which it overlaps, typically a top cover member arranged on the top frame member, and/or in a change in the extent of the overlap.

In the following, reference will be made only to flashing members, but it is to be understood that in this context this term is used for all of the sheet material components used for weather-proofing the transition between a window installed in a roof and the surrounding roofing, i.e. including also what is traditionally referred to as covering members and cladding members.

As an alternative or supplement to labyrinth seals, sealing gaskets have been used, but these too have been suitable only for very specific relative positions of the flashing members.

SUMMARY OF INVENTION

With this background, it is an object of the invention to provide a sealing gasket, a flashing arrangement, and method for sealing a gap between flashing members for a roof window, which allow the same flashing members and the same sealing gasket to be used for a wide range of roof window inclinations.

In a first aspect of the invention this and further objects are achieved with a sealing gasket of the kind mentioned in the introduction which is furthermore characterised in that the at least two legs of the attachment section project from a base section of the attachment section in a height direction, which is perpendicular to the length direction and the width direction, that each leg has a free edge furthest from the base section, and that the at least two legs project substantially in parallel, so that a first recess extending in the length direction is defined between the two legs, and that said attachment section comprises a second recess extending in parallel with the first recess, said first and second recesses being configured for engagement with a flange, ridge, or leg on a flashing member.

The provision of two recesses, each of which are suitable for a flange, ridge, or leg on a flashing member, allows the sealing gasket to be attached to one of the flashing members in two different positions, thus allowing it to be optimally positioned for two different inclination angles.

The second recess may be delimited on one side by a leg of the attachment section and on the other side by the sealing section.

The fact that the recesses are not just local but extending in the length direction allows a continuous engagement between the sealing gasket and a flange, ridge, or leg extending over the length of the flashing member, thereby contributing to an uninterrupted weather-proofing. It is presently preferred that the recesses extend over the entire length of the sealing gasket, thereby also making the sealing gasket suitable for manufacture by extrusion. It may, however, be advantageous that the recesses have closed ends so as to prevent water, air and dirty from penetrating into the recesses from the ends. For this purpose, it is also possible to provide the sealing gasket with one or more end plugs.

Similarly, a cavity provided in the sealing section in order to provide compressibility may extend over the entire length of the sealing gasket as is well-known from other gaskets, and it may be closed at the ends.

Alternatively, the sealing section may be made from a soft material, such as for example a polymer foam, in order to provide compressibility.

In order to allow adaptation to even more different inclinations, the attachment section may comprise at least one further leg extending in parallel with the at least two legs, and at least one further recess extending in parallel with the first and second recesses, which is delimited by the at least one further leg.

In one embodiment, the first recess, the second recess, possible further recesses, and the cavity of the sealing sections are arranged on a row when seen in the width direction. This allows the sealing section to be positioned where the gap between the two flashing members opens towards the exterior, while the attachment section extends inwards underneath one of the flashing members. By choosing one recess over another the sealing gasket can be moved inwards or outwards relative to the flashing members in order to achieve a proper positioning of the sealing section.

Even though the invention is here described with reference to embodiments where only one recess is used at a time it is to be understood that it is within the scope of the invention to provide the flashing member with two flanges, ridges, or legs, or combinations thereof and for these to engage with different recesses. This may even result in the formation of a labyrinth seal within the sealing gasket.

In one embodiment, the sealing section comprises two cavities arranged next to each other when seen in the width direction. As described with reference to the recesses above, this too provides increased versatility to the sealing gasket in that one or the other cavity may be compressed between the two flashing members, thereby allowing at least two different relative inclinations without having to use another recess of the attachment section.

As the sealing gasket will usually project slightly from the gap between the flashing members, the side of the sealing section furthest from the attachment section when seen in the width direction may have an inclined outer surface configured for draining off water. For the same reason, at least the sealing section of the sealing gasket should preferably be made from a material, which is resistant at least to exposure to UV radiation and water and which is preferably also resistant to temperatures in the range from −40 degrees Celsius to +80 degrees Celsius.

In an embodiment, the legs and/or the recesses project in the height direction from an interior surface of the sealing gasket, the interior surface extending in the width direction. An exterior surface of the sealing gasket is positioned opposite to the interior surface in the height direction. All legs, recesses, cavities, walls between cavities and the inclined outer surface, if any, extend below a plane that is defined by the exterior surface of the sealing gasket in the mounted state. In other words, the legs and the recesses project from the interior surface of the sealing gasket away from the exterior surface in the height direction and all parts of the sealing gasket are located on the same side of the exterior surface when seen in the height direction.

The legs may be formed integrally with the base section, and/or the attachment section may be integrally formed with the sealing section. This applies to all embodiments unless otherwise stated.

In one embodiment, at least one leg of the attachment section is provided with a thickening or projection so that a width of each recess at the free edges of the legs is smaller than a width of the respective recess closer to the base section. This may improve the connection between the sealing gasket and the flashing member as the smaller width at the free edges may allow a tight fit, so that they are kept in engagement by friction. Alternatively, or as a supplement, the flashing member and the attachment section may come into a snap-locking engagement, for example by the flashing member being provided with at least one recess or opening matching the size and shape of a projection on a leg of the attachment section.

The width closer to the base section may allow movement of the free edge of the flashing member, which may potentially reduce the wear on the sealing gasket which might otherwise result from a relative movement of the two, for example caused by temperature gradients. It is, however, also within the scope of the invention that the recesses have substantially the same width over the entire height. This width may correspond to the thickness of the part of the flashing member extending into the recess, thereby achieving a tight fit, but the width may also be bigger, allowing a certain sideways relative movement, which may for example be used for compensating for tolerances and variations.

In one embodiment, at least the legs of the attachment section are made from a resilient material allowing the legs to bend about and axis, which is substantially parallel to the length axis, and automatically return towards their original position. This may facilitate a tight fit and/or a snap-locking engagement between the sealing gasket and the flashing member.

In a second aspect of the invention the object of the invention explained above and further objects are achieved with a flashing arrangement including at least one sealing gasket of the type described above which is characterised in that the sealing section of the sealing gasket contacts both flashing members and closes a gap between them and where a flange, ridge, or leg on a flashing member projects into a recess of the attachment section. The embodiments and advantages described with reference to the first aspect of the invention above also applies to this aspect unless otherwise stated.

In one embodiment, a flange, ridge, or leg on a flashing member contacts a surface section of sealing section at a position above a cavity therein, and at least the surface section of the sealing section is made from a resilient material allowing the cavity to be deformed. The flange, ridge, or leg on the flashing member ensures that the contact with the sealing gasket is well-defined and the resilience of the material means that the sealing gasket presses back against the flashing member thus contributing to ensuring that the sealing gasket stays in contact with the flashing member at all times.

In a third aspect of the invention the object of the invention explained above and further objects are achieved with a method including the use of at least one sealing gasket of the type described above which is characterised in that in the sealing gasket used, at least two legs of the attachment section project from a base section of the attachment section in a height direction, which is perpendicular to the length direction and the width direction, that each leg has a free edge furthest from the base section, and that the at least two legs project substantially in parallel, so that a first recess extending in the length direction is defined between the two legs, and that said attachment section comprises a second recess extending in parallel with the first recess, and in that the sealing gasket is arranged such that a flange, ridge, or leg on a flashing member projects into a recess of the attachment section.

The embodiments and advantages described with reference to the first and second aspects of the invention above also applies to this aspect unless otherwise stated.

BRIEF DESCRIPTION OF DRAWINGS

In the following description embodiments of the invention will be described with reference to the schematic drawings, in which.

DESCRIPTION OF EMBODIMENTS

Figure 1:
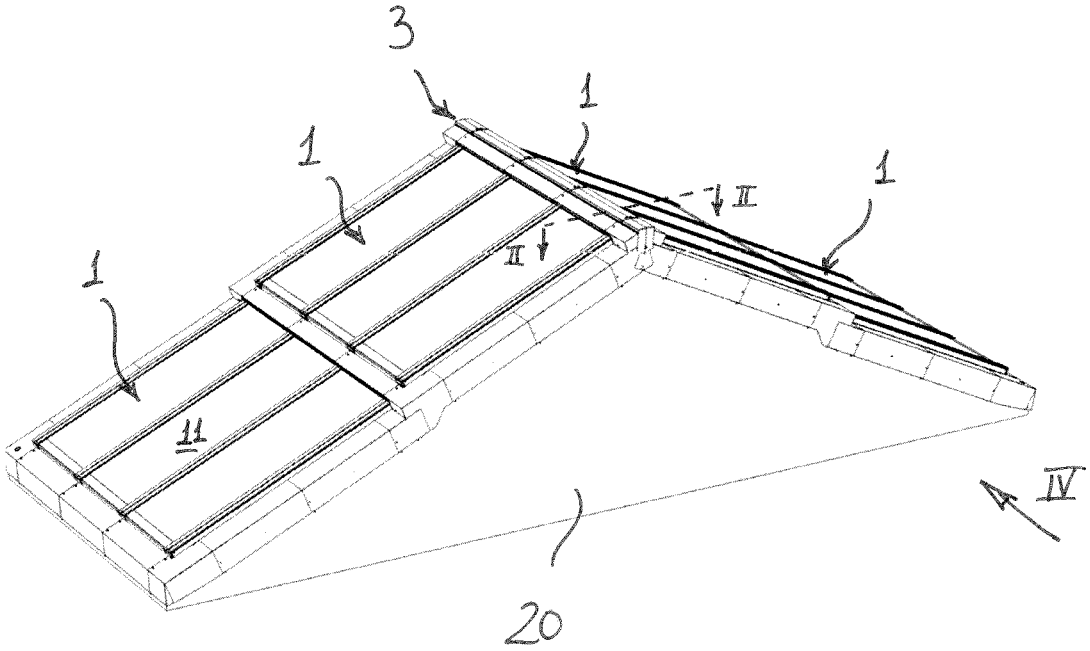
FIG. 1 is a perspective view of ridge structure including twelve roof windows.

Referring initially to FIG. 1, a ridge structure including twelve roof windows 1 and a gable 20 is shown. A flashing arrangement 3 provides a watertight transition between windows, between the windows and the gable, and between the windows and a surrounding roofing (not shown) as is well-known to the skilled person.

Figure 2:
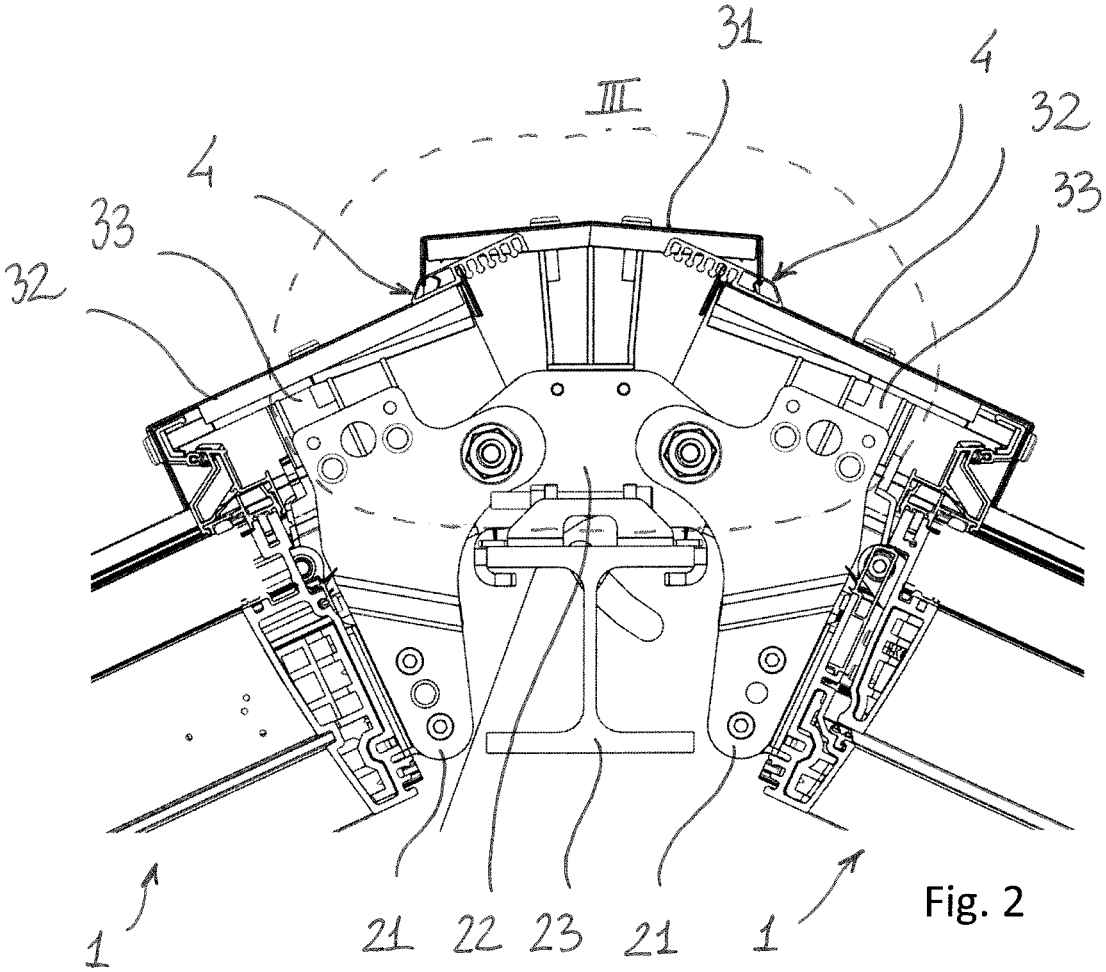
FIG. 2 is a partially cut-away cross-sectional view along the line II-II in FIG. 1, FIG. 3 a partially cut-away cross-sectional perspective view corresponding to the detail marked III-III in FIG. 2, FIG. 4 corresponds to FIG. 3 but seen directly from the end in the direction indicated by the arrow IV in FIG. 1 and showing an embodiment where the windows are mounted with a low inclination angle, FIG. 5 corresponds to FIG. 4 but showing an embodiment, where the two roof windows are installed with different inclination angles.

Turning now to FIG. 2 a cross-section along the line II-II in FIG. 1 illustrates how a single ridge flashing member 31 overlaps top flashing members 32 on both roof windows 1 so that rain water etc. landing on the ridge flashing member will drain off onto the top flashing members and from there onto the panes 11 of the roof windows. The ridge flashing member 31 and the top flashing members 32 are mounted on connector brackets 33, 34, which are mounted on mounting brackets 21, 22 used for connecting the roof windows 1 to a load-bearing beam 23 of the ridge structure.

Figure 3:
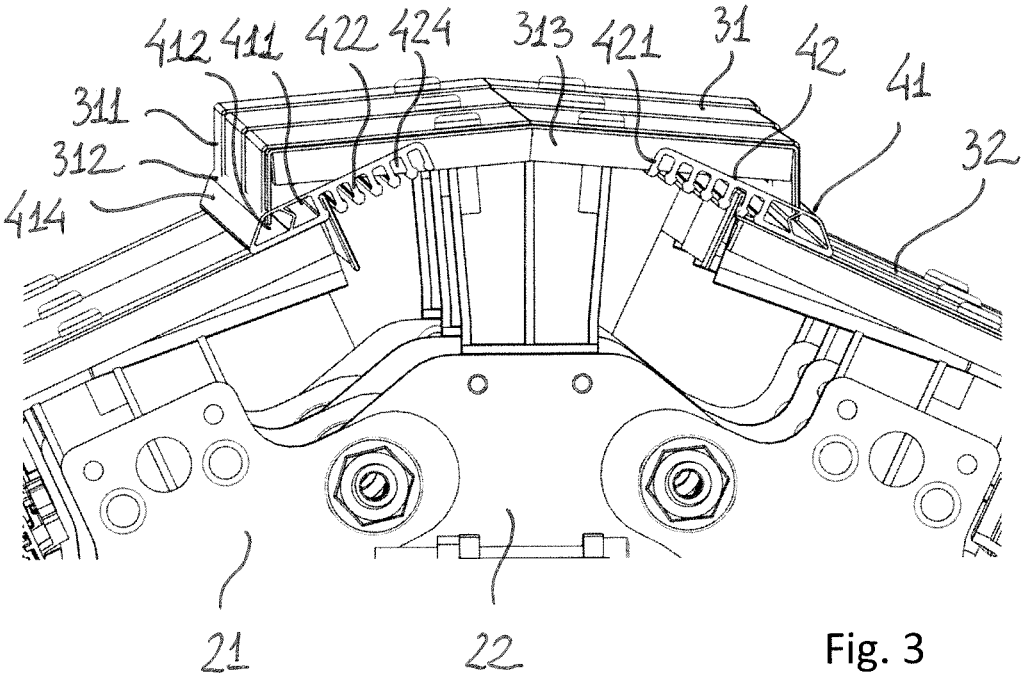
Figure 4:
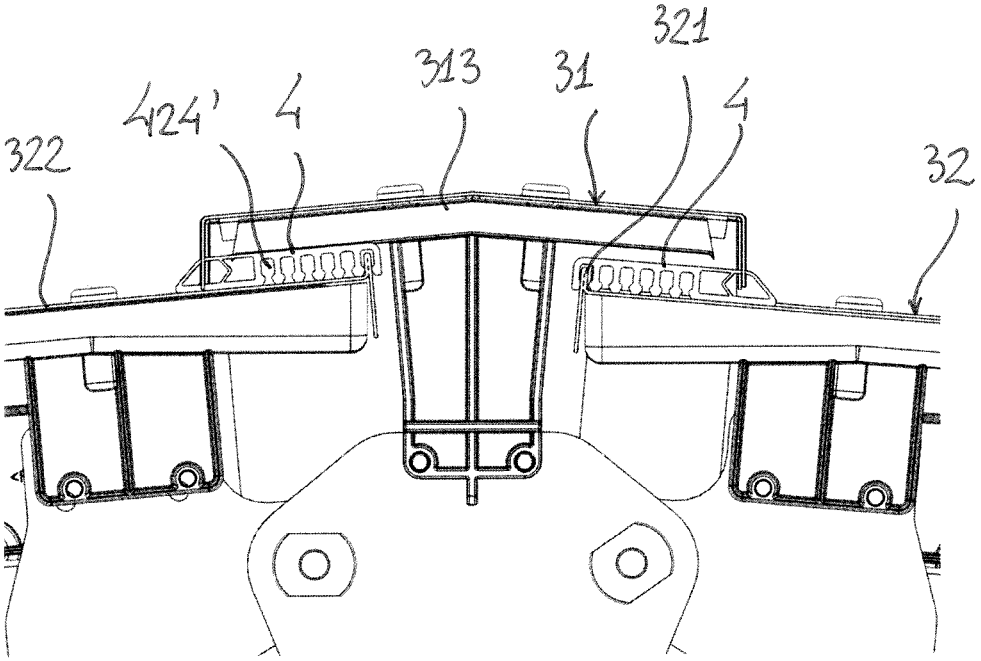
Figure 5:
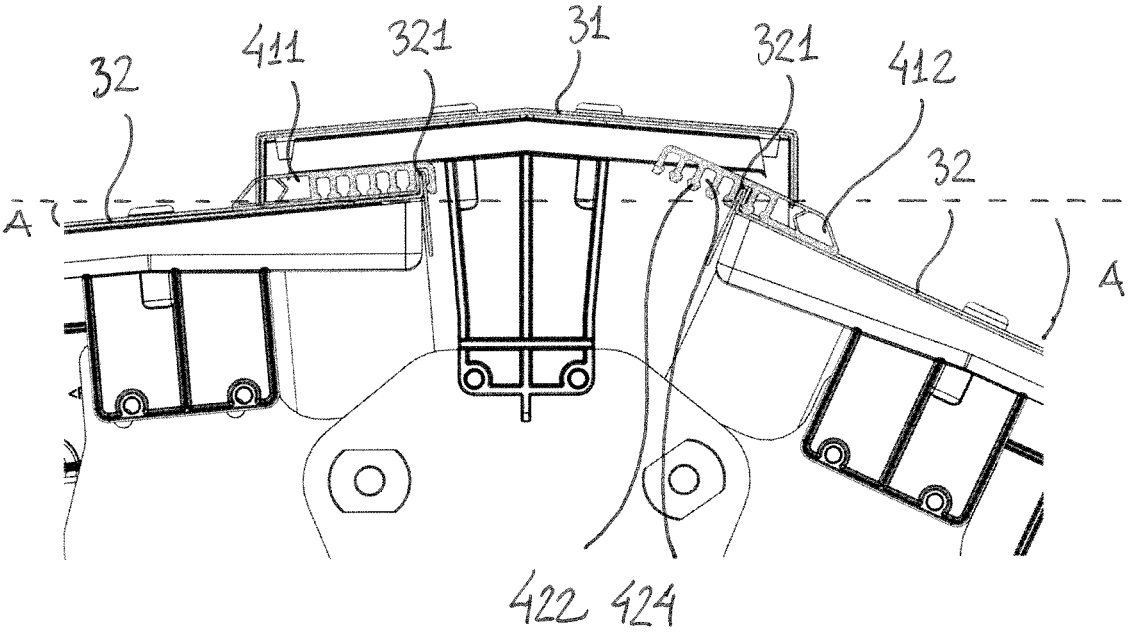

As is more clearly seen in FIGS. 3-5, sealing gaskets 4 are arranged in the gap between the ridge flashing member 31 and each top flashing member 32.

Figure 6:
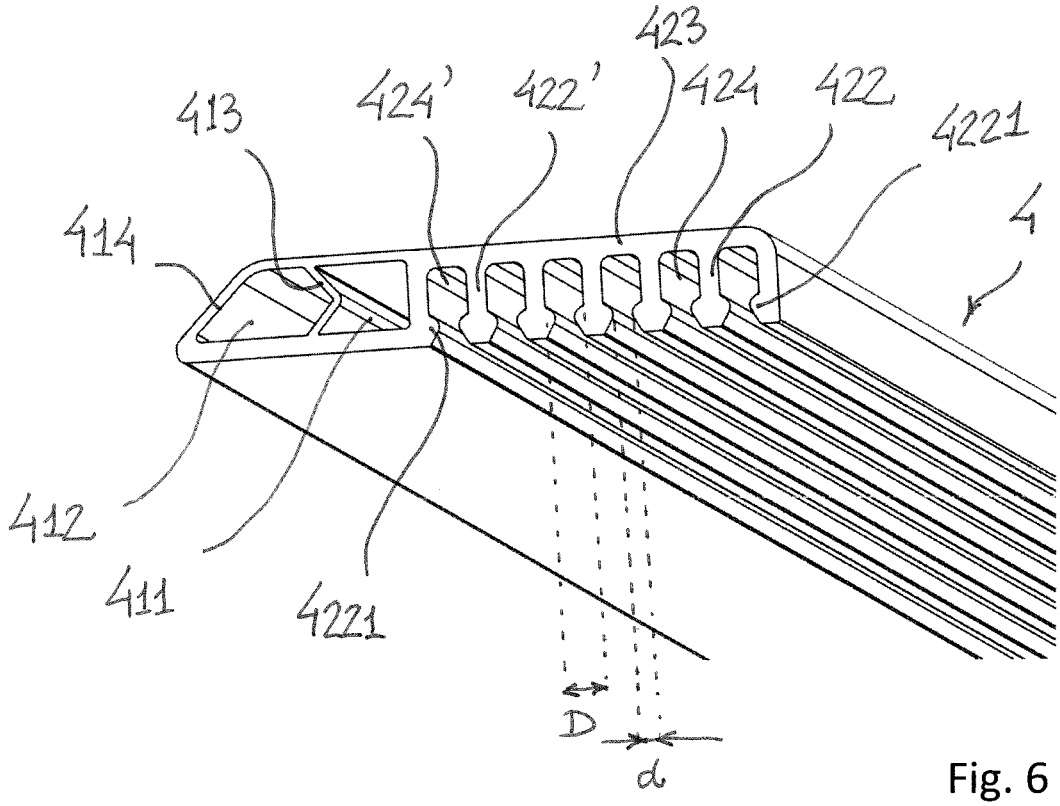
FIG. 6 is a perspective view of an end of a sealing gasket seen slightly from below, and FIG. 7 corresponds to FIG. 6 but showing the sealing gasket slightly from above.
Figure 7:
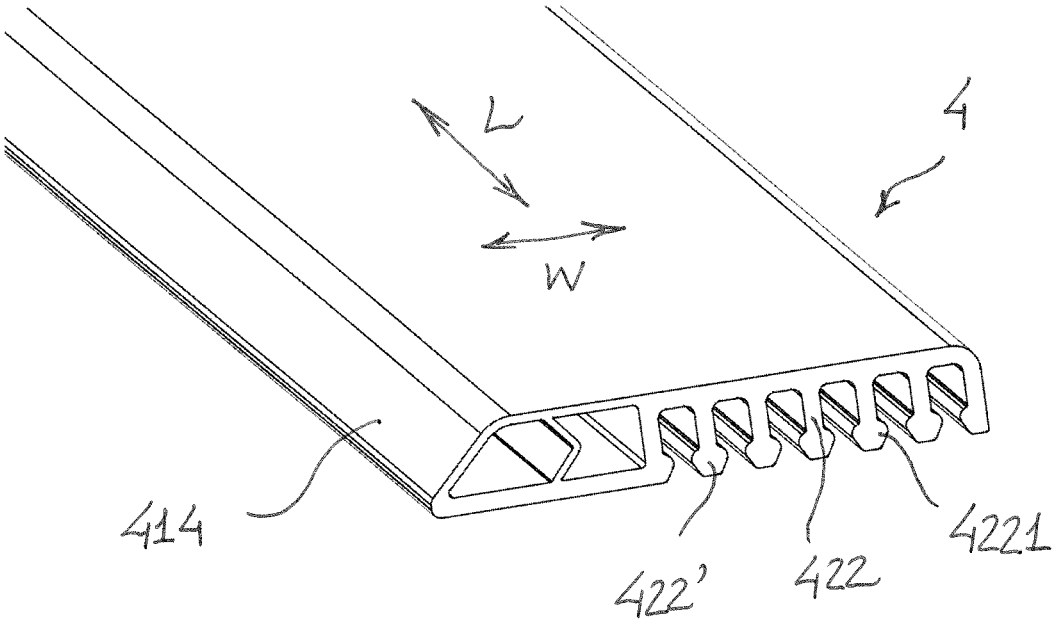

Referring now also to FIGS. 6 and 7, each sealing gasket consists of a sealing section 41 and an attachment section 42.

The sealing section is resting on an exterior surface 322 of the top flashing member 32 and a flange 311 of the ridge flashing member 31 projects downwards so that its free edge 312 rest on top of the sealing section.

In FIGS. 2-5 the sealing gaskets are shown in their initial undeformed state, but it is to be understood that the sealing gasket will be deformed by the downwards pressure exerted by the flange 311. In order to allow this deformation, the sealing section comprises two cavities 411, 412, but it would also be possible to make the sealing section from a soft material, such as for example a polymer foam, in which the cavities would not be needed. How the compressibility of the sealing section 41 is achieved has no bearing on the embodiment of the attachment section 42, except possibly influencing the choice of the material used, as it may be considered advantageous to make the entire sealing gasket 4 from the same material.

The wall 413 between the two cavities is here made with a V-shaped cross-sectional shape allowing it to yield when pressure is applied to the upper side of the sealing section 41, but it is understood that this need not be the case.

As may be seen, the side 414 of the sealing section 41 furthest from the attachment section 42 when seen in the width direction W projects slightly from the gap between the ridge flashing member 31 and the top flashing member 32 and will thus be exposed to rain water etc. In order to lead water away from the gap, the exposed side 414 of the sealing section 41 has an inclined outer surface configured for draining off water.

Both cavities 411, 412, the wall 413 between them, and the inclined outer surface 414 are extending in the length direction L over the entire length of the sealing gasket 4 as is also seen in FIGS. 6-7.

In the embodiment shown, the entire sealing gasket 4 in made from a resilient material and this allows even the attachment section to give way for other members. In this case the ridge flashing member 31 is provided with an insulating member 313 on the interior side which will force the end 421 of the attachment section furthest from the sealing section downwards. The apparent overlap of the sealing gasket 4 and the insulating member 313 will thus not be present in real life.

The attachment section 42 of the sealing gasket 4 shown in the drawing has six legs 422 projecting from a base section 423 and forming six recesses 424, a first recess 424' being formed between a first leg 422' and the sealing section 41. Each leg and each recess is extending over the entire length of the sealing gasket 4 as is also seen in FIGS. 6-7.

As is best seen in FIGS. 3-5, each top flashing member 32 is here provided with a flange 321 projecting substantially perpendicular to the exterior side 322 of the main section of the top flashing member and the sealing gasket 4 is mounted on this flange in a manner so that the flange projects into one of the recesses 424. In this embodiment the flange 321 is made by bending the sheet material, from which the top flashing member is made, twice, so that the flange is twice as thick as the rest of the top flashing member, but it is to be understood that this need not be the case. It may also have the same thickness or be replaced by a separate member (not shown) attached to a main body of the top flashing member.

In this embodiment, each leg 422 has a bulge 4221 at its free edge so that the distance d between the legs at the free edges and hence the width of each recess is smaller than the distance D between the legs closer to the base section 423. In this embodiment this feature simply reduces the risk of dirt entering the recesses 424, but in other embodiments it may mean that there is a tight fit between the projecting part, such as a flange, of the flashing member 32 and the attachment section 42.

The sealing gasket 4 on the left-hand side of FIGS. 2 and 3 is mounted with the flange 321 of the top flashing member 32 projecting into the first recess 424' closest to the sealing section 41 while the sealing gasket 4 on the right-hand side is mounted using the second recess from the sealing section. As is best seen in FIG. 4 this means that for roof windows 1 mounted with the same angle of inclination A the flange 311 on the ridge flashing member 31 contacts the sealing section 41 at different places. By choosing the right recess 424 it is thus possible to achieve an optimal positioning of the sealing gasket 4 in relation to the ridge flashing member 31. This applies independently of how the sealing gaskets and the flashing members are embodied, only the engagement between one of a plurality of recesses in the sealing gasket and a flange, ridge, or leg on the flashing member is required.

Turning now to FIG. 5 a situation, where the roof windows 1 are mounted with different angles A of inclination is shown. The left-hand window is mounted with the same angle inclination as in FIG. 4, i.e. approximately 5 degrees, while the right-hand roof window is mounted with an angle corresponding to that in FIGS. 1-3, i.e. approximately 25 degrees. As may be seen, the different angles means that both the distance between the ridge flashing member 31 and the top flashing member 32 and the extent of the overlap in a horizontal direction are different. This is characteristic of ridge structure where the angle is changed by rotation about a fixed point, here the connection between mounting brackets 21 and 22. In other embodiments only one of them will be change as the angle changes.

In order to compensate for these differences the sealing gasket 4 on the left-hand side in FIG. 5 is mounted using the recess 424 furthest from the sealing section 41, thus arranging the sealing section as far onto the exterior surface 322 of the top flashing member as possible, while the sealing gasket on the right-hand side is mounted using the second recess as described above. The provision of the row of recesses 424 thus enables the use of the same flashing members 31, 32 and the same sealing gaskets 4 for a wide range of inclination angles.

The sealing gasket 4 shown in the drawing is intended for use with angles of inclination of 5-25 degrees, but it is to be understood that the relative dimensions of the sealing section and the attachment section and parts thereof may be adjusted so that it may be used in other angle intervals. Likewise, it is to be understood that the number of cavities, legs and recesses may be changed. Changes to the specific configuration of the sealing gasket 4 may be made in order to allow the use with flashing members which are different from those shown in the drawing.

LIST OF REFERENCE NUMERALS

1 Roof window
11 Pane
20 Gable
21 Mounting bracket
22 Mounting bracket
23 Load-bearing beam
3 Flashing arrangement
31 Ridge flashing member
311 Flange
312 Free edge
313 Insulating member
32 Top flashing member
321 Flange
322 Exterior surface
33 Connector bracket
34 Connector bracket
4 Sealing gasket
41 Sealing section
411 Cavity
412 Cavity
413 Wall between cavities
414 Side furthest from attachment section
42 Attachment section
421 End furthest from sealing section
422 Leg
4221 Bulge
422' First leg
423 Base section
424 Recess
424' First recess
A Angle of inclination
d Distance between legs at free edges
D Distance between legs away from free edges
L Length direction
W W direction

The invention claimed is:

1. A sealing gasket for use between flashing members, comprising a compressible sealing section and an attachment section comprising at least two legs configured for engagement with a flashing member, said sealing gasket having a length direction and a width direction extending perpendicular to the length direction, and said compressible sealing section and said attachment section both extending over substantially an entire length of the sealing gasket when viewed in the length direction, the compressible sealing section having an outer inclined surface, two cavities arranged next to each other when viewed in the width direction and an inner wall, said inner wall being disposed between the two cavities, where each of the outer inclined surface, the two cavities and the inner wall extend over the entire length of the sealing gasket, the compressible sealing section further having a bottom wall extending in the width direction across a width of the inner wall and a width of each of the two cavities, the bottom wall being disposed below a lowermost portion of each of the two cavities and a lowermost portion of the inner wall, and the at least two legs of the attachment section project from a base section of the attachment section in a height direction, which is perpendicular to the length direction and the width direction, each leg of the at least two legs has a free edge furthest from the base section, and that the at least two legs project substantially in parallel, so that a first recess extending in the length direction is defined between the at least two legs, and that said attachment section comprises a second recess extending in parallel with the first recess, said first and second recesses being configured for engagement with one of a flange, a ridge, and a leg on a flashing member.

2. The sealing gasket according to claim 1, where the attachment section comprises at least one further leg extending in parallel with the at least two legs, and where at least one further recess extending in parallel with the first and second recesses is delimited by the at least one further leg.

3. The sealing gasket according to claim 2, where the first recess, the second recess, the at least one further recess, and the compressible sealing section are arranged in a row when viewed in the width direction.

4. The sealing gasket according to claim 3, where the compressible sealing section extends outwardly from the attachment section.

5. The sealing gasket according to claim 3, where the outer inclined surface forms a side of the compressible sealing section furthest from the attachment section when viewed in the width direction to drain off water.

6. The sealing gasket according to claim 3, where at least one leg of the at least two legs of the attachment section is provided with a thickening or projection so that a width of a respective recess of the first and second recesses at free edges of the at least two legs is smaller than a width of the respective recess closer to the base section.

7. The sealing gasket according to claim 3, where the at least two legs of the attachment section are made from a resilient material allowing the legs to bend about an axis, which is substantially parallel to the length direction, and automatically return towards an original position of the at least two legs.

8. The sealing gasket according to claim 2, where each of said two cavities are disposed between said inclined outer surface and the attachment section.

9. The sealing gasket according to claim 2, where the compressible sealing section extends outwardly from the attachment section.

10. The sealing gasket according to claim 2, where the outer inclined surface forms a side of the compressible sealing section furthest from the attachment section when viewed in the width direction to drain off water.

11. The sealing gasket according to claim 2, where at least one leg of the at least two legs of the attachment section is provided with a thickening or projection so that a width of a respective recess at free edges of the at least two legs is smaller than a width of the respective recess of the first and second recesses closer to the base section.

12. The sealing gasket according to claim 2, where the at least two legs of the attachment section are made from a resilient material allowing the legs to bend about an axis, which is substantially parallel to the length direction, and automatically return towards an original position of the at least two legs.

13. The sealing gasket according to claim 1, where the compressible sealing section extends outwardly from the attachment section.

14. The sealing gasket according to claim 1, where at least one leg of the at least two legs of the attachment section is provided with a thickening or projection so that a width of a respective recess of the first and second recesses at free edges of the at least two legs is smaller than a width of the respective recess of the first and second recesses closer to the base section.

15. The sealing gasket according to claim 1, where the at least two legs of the attachment section are made from a resilient material allowing the legs to bend about an axis, which is substantially parallel to the length direction, and automatically return towards an original position of the at least two legs.

16. The sealing gasket according to claim 1, where the first recess, the second recess, and the compressible sealing section are arranged in a row when viewed in the width direction.

17. A roof window assembly including at least one roof window having a frame, at least two flashing members and at least one sealing gasket, the at least one sealing gasket comprising a compressible sealing section and an attachment section comprising at least two legs engaging one of the at least two flashing members, said at least one sealing gasket having a length direction and a width direction extending perpendicular to the length direction, and said compressible sealing section and said attachment section both extending over substantially an entire length of the at least one sealing gasket when viewed in the length direction, the at least two legs of the attachment section project from a base section of the attachment section in a height direction, which is perpendicular to the length direction and the width direction, each leg of the at least two legs has a free edge furthest from the base section, and that the at least two legs project substantially in parallel, so that a first recess extending in the length direction is defined between the at least two legs, and said attachment section comprises a second recess extending in parallel with the first recess, said first recess receiving and engaging one of a flange, a ridge, and a leg of a first flashing member of the at least two flashing members when the at least one sealing gasket is in a first operational position and said second recess receiving and engaging one of the flange, the ridge, and the leg of the first flashing member of the at least two flashing members when the at least one sealing gasket is in a second operational position, wherein the second operational position is different from the first operational position, where the compressible sealing section of the at least one sealing gasket contacts each of the at least two flashing members and closes a gap between them and where one of the flange, the ridge, and the leg of the first flashing member projects into a corresponding recess of the first and second recesses of the attachment section.

18. The roof window assembly according to claim 17, where one of a flange, a ridge, and a leg of a second flashing member of the at least two flashing members contacts a surface section of the compressible sealing section at a position above a cavity therein, and where at least the surface section of the compressible sealing section is made from a resilient material allowing the cavity to be deformed.

19. A sealing gasket for use between flashing members, comprising a compressible sealing section and an attachment section comprising at least two legs configured for engagement with a flashing member, said sealing gasket having a length direction and a width direction extending perpendicular to the length direction, and said compressible sealing section and said attachment section both extending over substantially an entire length of the sealing gasket when viewed in the length direction, the at least two legs of the attachment section project from a base section of the attachment section in a height direction, which is perpendicular to the length direction and the width direction, each leg of the at least two legs has a free edge furthest from the base section, and that the at least two legs project substantially in parallel, so that a first recess extending in the length direction is defined between the at least two legs, and that said attachment section comprises a second recess extending in parallel with the first recess, wherein said sealing gasket is configured such that when said sealing gasket is installed in a first operating position one of a flange, a ridge, and a leg on the flashing member extends into and engages said first recess and when said sealing gasket is installed in a second operating position the flange, the ridge, and the leg on the flashing member extends into and engages said second recess.

20. A method of sealing a gap between at least two flashing members for a roof window, comprising:

arranging at least two flashing members relative to a frame of a roof window such that a gap exists between the at least two flashing members;

bringing at least a compressible sealing section of a sealing gasket into contact with a first flashing member and a second flashing member of the at least two flashing members and arranging the sealing gasket so that the sealing gasket closes the gap between the first flashing member and the second flashing member, providing said sealing gasket with an attachment section comprising at least two legs configured for engagement with the first flashing member, said sealing gasket having a length direction and a width direction extending perpendicular to the length direction, and said compressible sealing section and said attachment section both extending over substantially an entire length of the sealing gasket when viewed in the length direction, orienting the sealing gasket such that the at least two legs of the attachment section project from a base section of the attachment section in a height direction, which is perpendicular to the length direction and the width direction, that each leg of the at least two legs has a free edge furthest from the base section, and that the at least two legs project substantially in parallel, so that a first recess extending in the length direction is defined between the at least two legs, and that said attachment section comprises a second recess extending in parallel with the first recess, arranging the sealing gasket such that one of a flange, a ridge, and a leg of the first flashing member projects into one of the first recess and the second recess of the attachment section.

21. The method of claim 20, where the compressible sealing section includes an outer inclined surface, two cavities arranged next to each other when viewed in the width direction and an inner wall, said inner wall being disposed between the two cavities, where each of the outer inclined surface, the two cavities and the inner wall extend over the entire length of the sealing gasket.

* * * * *